US010688333B2

(12) United States Patent
Guidicipietro

(10) Patent No.: US 10,688,333 B2
(45) Date of Patent: Jun. 23, 2020

(54) INFLATABLE EXERCISE DEVICE AND METHOD

(71) Applicant: Jason Guidicipietro, Mountainside, NJ (US)

(72) Inventor: Jason Guidicipietro, Mountainside, NJ (US)

( * ) Notice: Subject to any disclaimer, the term of this patent is extended or adjusted under 35 U.S.C. 154(b) by 51 days.

(21) Appl. No.: 16/115,607

(22) Filed: Aug. 29, 2018

(65) Prior Publication Data

US 2019/0083840 A1 Mar. 21, 2019

Related U.S. Application Data

(60) Provisional application No. 62/558,970, filed on Sep. 15, 2017.

(51) Int. Cl.
*A63B 21/16* (2006.01)
*A63B 69/20* (2006.01)
(Continued)

(52) U.S. Cl.
CPC ..... *A63B 21/1636* (2013.01); *A63B 21/0602* (2013.01); *A63B 21/0603* (2013.01); *A63B 21/0605* (2013.01); *A63B 21/0726* (2013.01); *A63B 21/1645* (2013.01); *A63B 69/20* (2013.01); *A63B 21/169* (2015.10);
(Continued)

(58) Field of Classification Search
CPC ..... A63B 21/1636; A63B 21/1645; A63B 21/0603; A63B 21/0602; A63B 21/0726; A63B 21/0605; A63B 21/169; A63B 2244/102; A63B 2225/09; A63B 2225/62; A63B 21/4013; A63B 69/20–345; A63B 69/26; A63B 69/0073–0088
See application file for complete search history.

(56) References Cited

U.S. PATENT DOCUMENTS 4,042,241 A * 8/1977 Collins ..... A63B 69/0086 473/424
4,121,829 A * 10/1978 Petrusek ..... A63B 69/0086 473/576
(Continued)

FOREIGN PATENT DOCUMENTS

CA 2818475 A1 8/2013
CN 2464380 Y 12/2001

OTHER PUBLICATIONS

"Makiwara—Products—Best Karate-Gi—Dealer of Hirota-Gi in Europe", www.bestkarategi.eu/products.php?p=40, Jun. 1, 2017, 2 pages, Budo Centrum Amsterdam.

*Primary Examiner* — Andrew S Lo
(74) *Attorney, Agent, or Firm* — Gearhart Law LLC.

(57) ABSTRACT

An exercise device and an inflatable alternative are provided. The exercise device is composed of a planar base attached to block(s). The block(s) may serve as cushioning or weighted items to enable a variety of exercises. The planar base is securable against a structure such as a door frame. The planar base is also convertible to a bench with shaft(s) that connect block(s) to form legs for the bench. The inflatable alternative includes a top end that is securable to the structure. A bottom end of the inflatable alternative is securable to a user through an ankle cuff. The ankle cuff provides the user a measure of control over a mobility of the inflatable alternative during an exercise.

11 Claims, 7 Drawing Sheets

(51) Int. Cl.
*A63B 21/06* (2006.01)
*A63B 21/00* (2006.01)
*A63B 21/072* (2006.01)

(52) U.S. Cl.
CPC ..... *A63B 21/4013* (2015.10); *A63B 2225/09* (2013.01); *A63B 2225/62* (2013.01); *A63B 2244/102* (2013.01)

(56) References Cited

U.S. PATENT DOCUMENTS 4,572,504 A 2/1986 DiBartolo
5,186,696 A * 2/1993 Pfefferle ..... A63B 21/1627 482/38
5,554,088 A * 9/1996 Zlojutro ..... A63B 69/004 482/83
5,769,761 A * 6/1998 Zagata, Jr. ..... A63B 69/34 482/83
6,152,838 A * 11/2000 Killion ..... A63B 43/007 273/331
6,244,993 B1 * 6/2001 Dunn ..... A63B 69/201 482/83
6,352,484 B1 * 3/2002 Killion ..... A63B 43/007 273/331
7,063,648 B1 6/2006 Brigham
8,790,198 B1 * 7/2014 Russell ..... A63B 69/345 473/422
2002/0010057 A1 * 1/2002 Bouvier ..... A63B 69/201 482/86
2003/0125168 A1 * 7/2003 Hackaday ..... A63B 69/206 482/89
2004/0204299 A1 * 10/2004 Shirley ..... A63B 24/0021 482/81
2006/0100067 A1 * 5/2006 Washburn ..... A63B 69/201 482/83
2006/0183609 A1 * 8/2006 Flynn ..... A63B 21/0004 482/124
2007/0287615 A1 * 12/2007 Gilchrist ..... A63B 21/0004 482/124
2009/0215594 A1 * 8/2009 Panaiotov ..... A63B 21/0552 482/130
2009/0227384 A1 * 9/2009 Reynolds ..... A63B 69/0057 473/207
2010/0248908 A1 * 9/2010 Ramsay-Matthews ..... A63B 69/004 482/89
2010/0267531 A1 * 10/2010 Hetrick ..... A63B 21/4017 482/139
2010/0323825 A1 * 12/2010 Lentz, Jr. ..... A63B 69/0002 473/452
2011/0237404 A1 * 9/2011 Smith ..... A63B 69/201 482/83
2012/0252637 A1 * 10/2012 Pellot ..... A63B 69/20 482/89
2012/0302412 A1 * 11/2012 Nail ..... A63B 21/0442 482/129
2013/0065735 A1 * 3/2013 Conarty ..... A63B 69/20 482/89
2013/0165298 A1 * 6/2013 Demsey ..... A63B 21/00047 482/40
2013/0217547 A1 * 8/2013 Hinds ..... A63B 7/00 482/96
2013/0288861 A1 * 10/2013 Cole ..... A63B 21/0618 482/102
2014/0031182 A1 * 1/2014 Donofrio ..... A63B 21/0442 482/129
2014/0094350 A1 * 4/2014 Sagall ..... A63B 69/201 482/89
2014/0148314 A1 * 5/2014 Schlicher ..... A63B 69/203 482/87
2014/0336014 A1 * 11/2014 Francis ..... A63B 69/203 482/88
2015/0057132 A1 2/2015 Pedone
2015/0133273 A1 * 5/2015 Sweeney ..... A63B 21/0023 482/91
2015/0258359 A1 * 9/2015 Velikin ..... A63B 1/00 482/40
2015/0273306 A1 * 10/2015 Fu ..... A63B 69/201 482/87
2016/0121191 A1 * 5/2016 Crespo ..... A63B 69/0053 434/258
2017/0087435 A1 * 3/2017 Jones ..... A63B 21/1663
2017/0239507 A1 * 8/2017 Haas ..... A63B 21/0552
2018/0050253 A1 * 2/2018 Magrino ..... A63B 69/20
2018/0296897 A1 * 10/2018 Horn ..... A63B 69/002

* cited by examiner

INFLATABLE EXERCISE DEVICE AND METHOD

CLAIM OF PRIORITY

This application claims the priority benefit of U.S. Provisional Patent Application No. 62/558,970, filed on Sep. 15, 2017, the contents of which are hereby incorporated by reference into this application.

FIELD OF THE EMBODIMENTS

The field of the embodiments relate to a modular device for exercising, that functions as a bench, a weight set, and a punching stand that is configured to hang from a door, a door frame, or a wall.

BACKGROUND OF THE EMBODIMENTS

People enjoy working out as a way of staying fit, healthy and in shape. Punching bags, stands, and other boxing and karate equipment are a popular way of working out. However, people also like variety and switching exercise regimens and using different equipment. However it may become expensive to buy and store multiple types of exercise equipment. Punching bags with multi use functionality may fulfill diverse exercise demands. However, multi-use punching bags have several drawbacks.

U.S. Pat. No. 7,063,648 pertains to a combination of an exercise mat and a punching bag assembly. The combination includes a base which needs to be filled with a liquid, and a panel cushioning material panel that fits around the base. The combination's utilization of a heavy bag makes the bag hard to move.

U.S. Pub. 2015/0057132 pertains to a punching bag. The punching bag includes an attachment mechanism. However, the attachment mechanism does not allow for forceful punching, and the size of the punching bag does not allow for modular use, or use for any other fitness activity.

None of the art described above addresses all of the issues that the present invention does. The present application allows for a user to move the punching bag, hit it with force, and use the modular components of the punching bag for various exercises in addition to punching.

SUMMARY OF THE EMBODIMENTS

The present invention and its embodiments relate to a modular exercise device. An example of the modular exercise device may include an inflatable exercise apparatus. The inflatable exercise apparatus may include an inflatable component with a top end and a bottom end. The inflatable component may include a rectangular shape when inflated. A top loop may be integrated to the top end and a bottom loop may be integrated to the bottom end. A clamp may be configured to secure to a structure. The clamp may be configured to attach to the top loop. Furthermore, an ankle cuff may be configured to attach to the bottom loop.

In another embodiment of the present invention, an exercise system may be described. The exercise system may include an inflatable component with a top end and a bottom end. the inflatable component may include a rectangular shape. A top loop may be integrated to the top end and a bottom loop may be integrated to the bottom end. A clamp may be secured to a structure (such as a top section of a door frame). The clamp may be attached to the top loop with a fixed length cord. Furthermore, an ankle cuff may be configured to couple to the bottom loop with an adjustable length cord.

In yet another embodiment of the present invention, a method of configuring an inflatable exercise apparatus is described. The method may include securing a clamp to a structure. The structure may include a top section of a door frame. Next, an inflatable component may be connected to the clamp. A top loop may be integrated to a top end of the inflatable component. The top loop may be attached to the clamp with a cord. Furthermore, an ankle cuff may be attached to a bottom loop. The bottom loop may be integrated to the inflatable component. The ankle cuff may be attached to the bottom loop with another cord. The other cord may include an adjustable length. The ankle cuff may also be secured to a body component. The body component may include a leg.

It is an object of the embodiments of the present invention to provide an inflatable exercise apparatus for contact based exercises.

It is another object of the embodiments of the present invention to an inflatable component of the apparatus covered with a material such felt, cloth, or leather based on an exercise type.

It is another object of the embodiments of the present invention to provide the inflatable component in a rectangular shape when inflated.

It is another object of the embodiments of the present invention to secure the inflatable component to a structure such as a top section of a door frame with a clamp.

It is another object of the embodiments of the present invention to secure the inflatable component to a user with an ankle cuff.

These and other features, aspects and advantages of the present invention will become better understood with reference to the following drawings, description and claims.

DESCRIPTION OF THE PREFERRED EMBODIMENTS

Figure 1A:
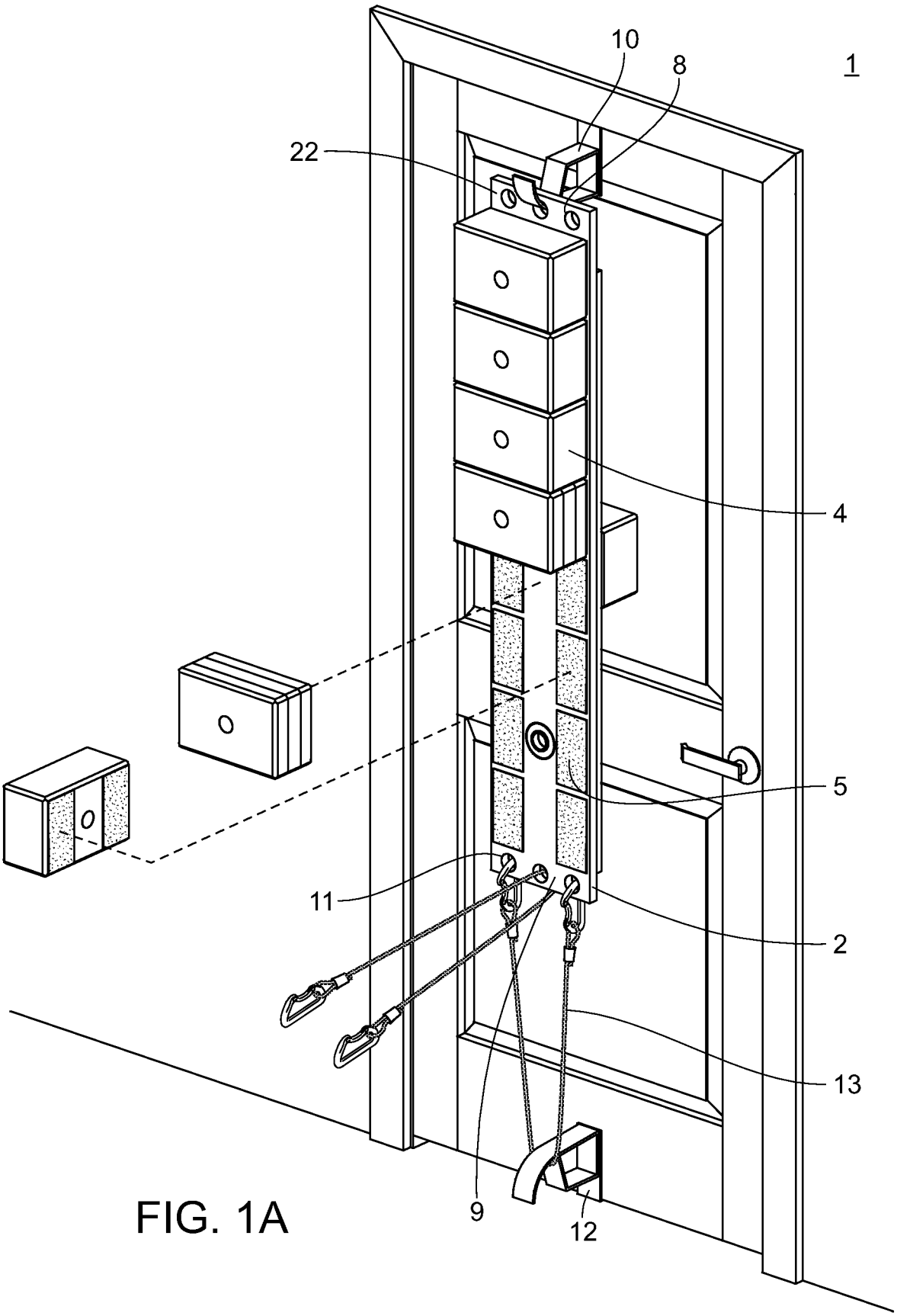
FIG. 1A shows a top perspective view of an embodiment of the invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations may be made thereto.

FIG. 1A shows a device 1 for exercising which may be used as a punching or kicking bag, converted to a bench press, used as a dumbbell or as a yoga block. FIG. 1A displays a planar base 2 with a front section, a back section, a top end 22, and a bottom end 9. The planar base 2 may include a rectangular shape. The planar base 2 may be composed of a solid material such as a wood, a plastic, or a hard rubber. The material of the planar base 2 may support a punch or a kick provided by a user at a midpoint of the planar base 2. Alternatively, the material of the planar base 2 may support a weight of the user (such as an adult) while the user is laying down on the planar base 2.

The planar base 2 may include an attachment location 5. A block 4 may be attached to the planar base 2 at the attachment location 5. The planar base 2 may be configured with a number of the attachment locations 5 to attach a number of the blocks 4. In an example scenario, four of the blocks 4 may typically be attached to the planar base 2. Furthermore, a maximum of ten of the blocks 4 may be attached to the planar base 2.

As seen further in FIG. 1A, the blocks 4 may include varying sizes. The blocks 4 may include varying thicknesses, weights, densities, textures, and/or compositions. The blocks 4 with varying attributes may produce varying recoil effects when punched or kicked. Furthermore, varying a texture of the block 4 may also vary feedback from a contact exercise. Additionally, the block 4 may include a rectangular shape. An example of a composition of the block 4 may include a variety of materials such as a deformable material.

The block 4 may be attached to the planar base 2 with a hook and loop mechanism. Alternatively, the block 4 may be attached to the planar base 2 with a magnet based mechanism.

The planar base 2 may include a top connection 8 integrated to the top end 22 of the planar base 2 and a bottom connection 11 integrated to the bottom end 9 of the planar base 2. The connections (8 and 11) allow the planar base 2 to be hung on a wall, a door, or a door frame in either direction. The top connection 8 may be attached to a hook 10 that is secured to a door, door frame, or other structure. Alternatively, the top connection 8 may be secured to the hook 10 (or a clamp) with a cord. The cord may be extendible or not depending on the use case scenario.

The bottom connection 11 may be used to secure the bottom end 9 of the planar base 2 to a structure such as a door or a wall. The hook 12 may be connected to the bottom connection 11 with a cord 13. The cord 13 may be extendible or not. Furthermore, the top end 22 and the bottom end 9 may include additional connections to allow the hooks (10 or 12) to secure the planar base 2 while suspended in air. The connections (8 and 11) may be between 1 cm and 5 cm in diameter (approximately). The hooks (10 or 12) may also include a dampening material to help absorb a force of the contact based exercise. The dampening material may be a coating, or a spring as part of the hooks (10 or 12). The dampening material may absorb a shock from the contact based exercise. The dampening material may be composed of a soft rubber or a plastic, or a deformable material. The hooks (10 or 12) may be attached to the structure (such as a wall or a door) using screws, bolts, or other fasteners.

Figure 1B:
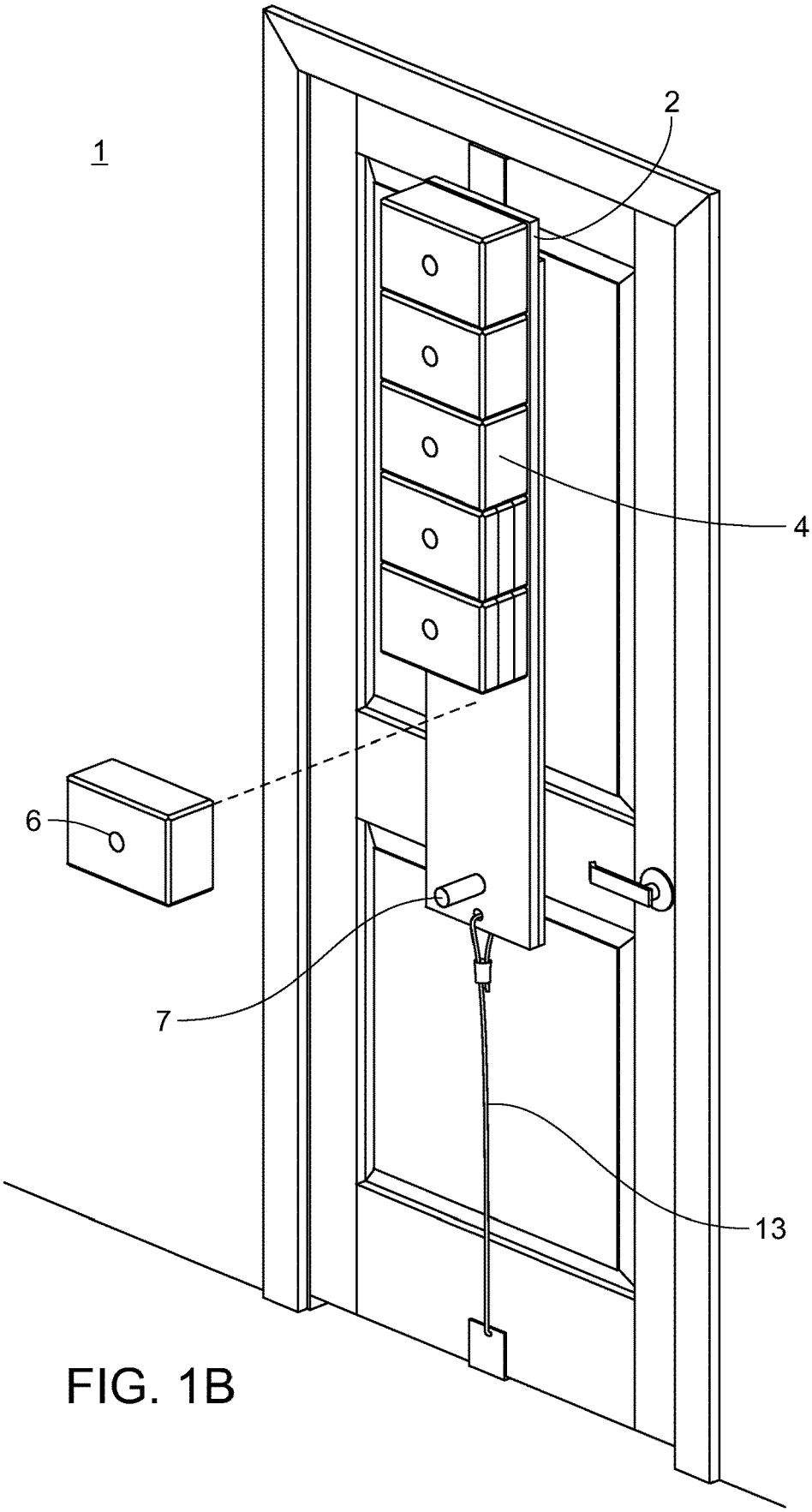
FIG. 1B shows a second block attachment method.

As seen in FIG. 1B, the block 4 may include an alternative attachment mechanism. An bottom end of the planar base 2 may be connected to a hook on the door with a single cord 13. Furthermore, the planar base 2 may include a peg 7 to attach the block 4. The block 4 may be attached by inserting the peg 7 to an aperture on a central position of the block 4. The peg 7 and the aperture may have a threaded or push fit connection.

Figure 2:
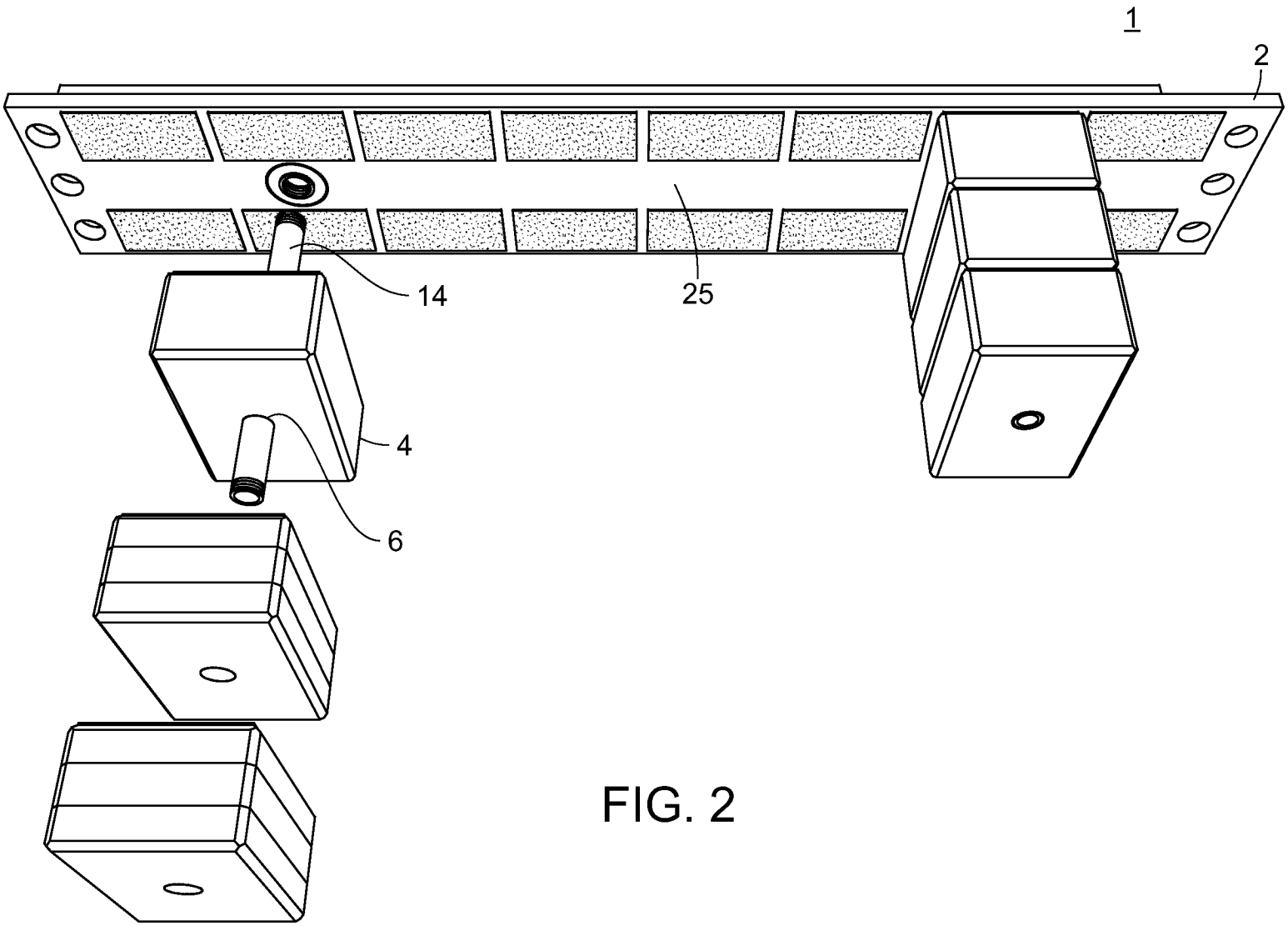
FIG. 2 shows a bottom perspective of an embodiment of the invention including supports.

As seen in FIG. 2, the device 1 may be used as a bench. The bench may be formed by connecting a support article 14 to a back section 25 of the planar base 2. An example of the support article 14 may include a shaft. The planar base 2 may have multiple locations for connecting to the support article 14. The connection may be a threaded connection or a push fit connection. The support article 14 may have a cylindrical shape. A width of the support article 14 may accommodate a connection on the planar base 2.

The device 1 may be formed by connecting the block 4 to the support article 14. The support article 14 may be inserted to an aperture 6 on the block 4. A number of the block 4 may be connected to the support article 14 to form a leg of the device 1. A height of the leg may be adjusted by inserting or removing the block 4 to/from the support article 14. Furthermore, the block 4 may be composed of multiple sections. One or more sections may be added and/or removed to adjust a height of the block 4. Adjusting the sections of the block 4 may provide additional granularity to configure the height of the leg of the device 1.

Figure 3:
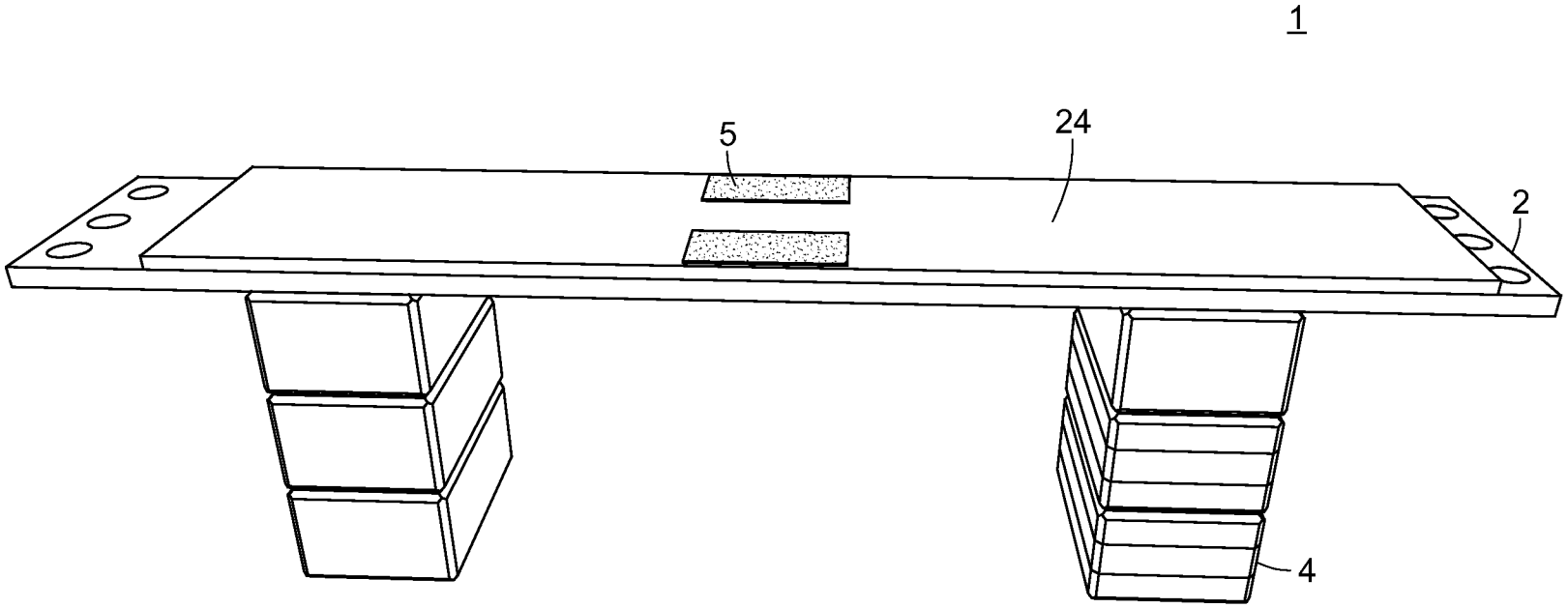
FIG. 3 shows a side perspective view of the embodiment of the invention.

As seen in FIG. 3, the device 1 may include a bench formed from a number of the block 4 that serve as legs for the planar base 2. The planar base 2 may also include an attachment location 5 on a front section 24. The attachment location 5 may be used to attach the block 4 or other items on the front section 24 to serve as an aid during an exercise. Alternatively, the planar base 2 may include a number of the attachment location 5 that may allow attachment of a number of the block 4 on the front section 24 of the planar base 2. In an example scenario, the blocks 4 may be used as an alternative surface during an exercise. The block 4 may be composed of deformable (spongy) material. The number of the block 4 may be attached to a number of the attachment location 5 to cover the surface of the front section 24 of the planar base 2. The block 4 (or other deformable material) may cover 50% or more of the front section 24 of the planar base 2 to provide a comfortable surface for exercising.

Figure 4:
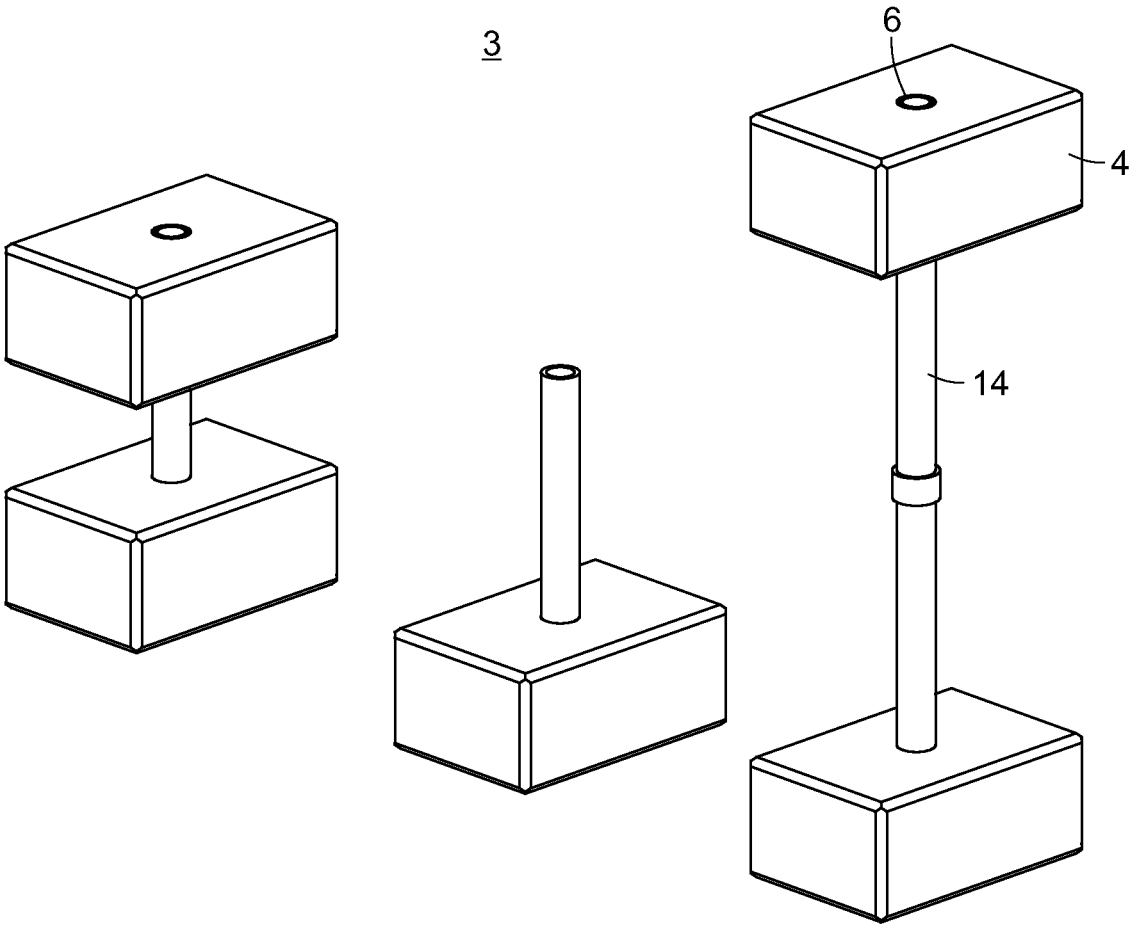
FIG. 4 shows an embodiment of the blocks connected to form a dumbbell and hammer.

As seen in FIG. 4, a device 3 may be constructed from the support article 14 and the block 4. An example of the device 3 may include a dumbbell. The dumbbell may be constructed by attaching a pair of the block 4 to the support article 14. The aperture 6 in the block 4 may be used to create a friction fit connection or as a threaded connection to the support article 14.

Furthermore, the block 4 may be composed of an expandable container. The container may be filled with a fluid (such as water) to adjust a weight of the block 4. As such, a weight of the dumbbell may be increased or decreased by adding or removing the fluid from the block 4. Alternatively, a number of the block 4 may be added or removed from the support article 14 to increase or decrease the weight of the dumbbell.

Figure 5:
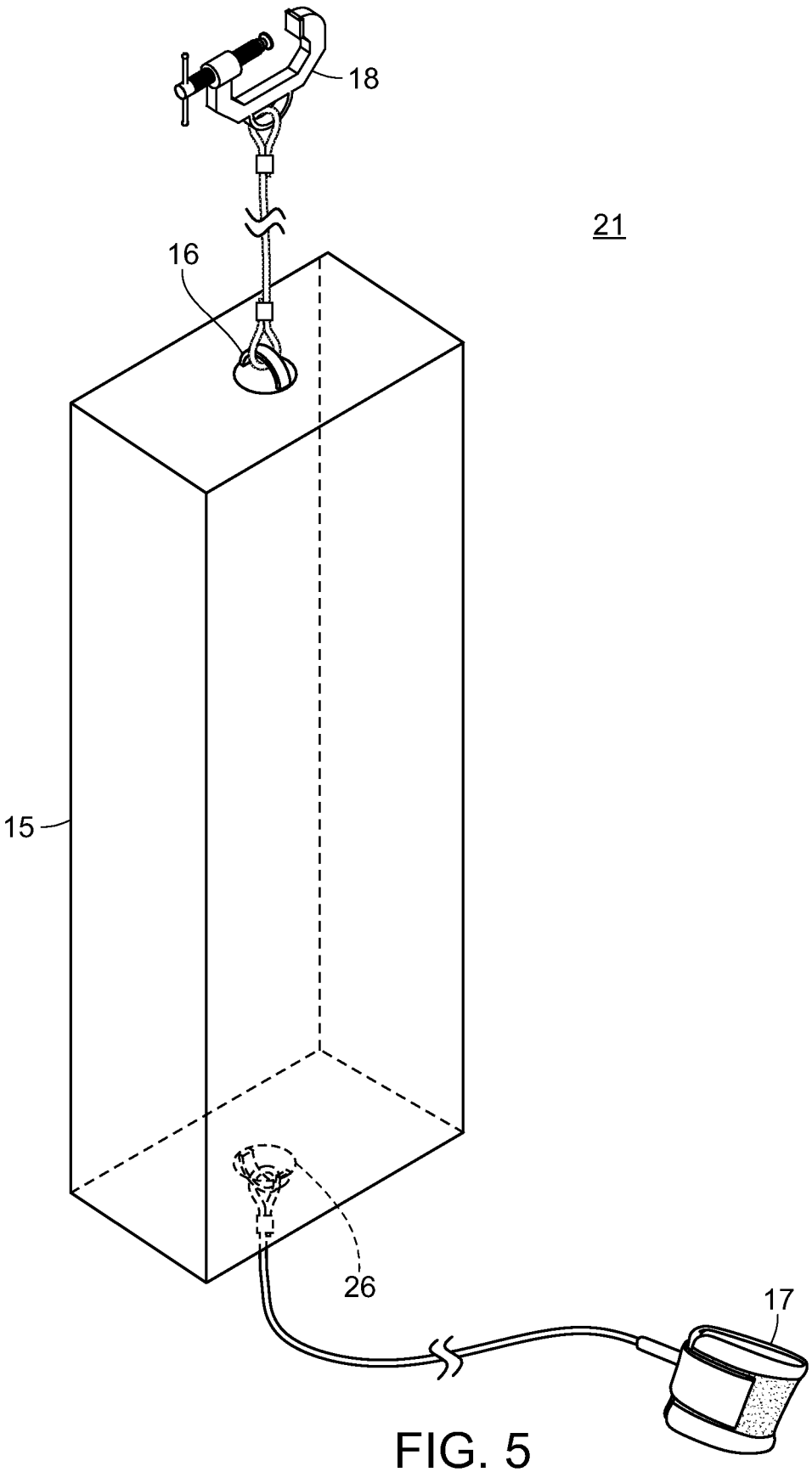
FIG. 5 shows an inflatable exercise apparatus.

As seen in FIG. 5, an inflatable exercise apparatus 21 includes an inflatable component 15. The inflatable component 15 may be filled with a gas or a fluid. In an example scenario, the inflatable component 15 may have multiple compartments that are partitioned to configure the inflatable component 15 with adjustable density and weight based on filling all or a subset compartments with the gas or fluid. Furthermore, the inflatable component 15 may enclose equipment necessary for inflation such as a pump, or an intake, among others. Alternatively, the inflatable component 15 may only include an intake and is configured for inflation with an external device such as a pump.

The inflatable component 15 may have a box like shape to provide a number of surfaces to a user. Each surface may have the same shape or size. Alternatively, each surface may have varying shapes or sizes. For example, the inflatable component 15 may have a length of 122 cm, a width of 25.4 cm, and a depth of 61 cm. The dimensions may be approximate. The dimensions may also be adjustable by inflating and/or deflating the inflatable component 15.

In an example scenario, the user may interact with an initial surface of the inflatable component 15 for an initial exercise type and start another interaction with another surface of the inflatable component 15 for another exercise type. Alternatively, the inflatable component 15 may have a tubular shape to provide the user a uniform surface during an exercise.

The surface(s) of the inflatable component 15 may be covered with a cloth, a felt, and/or a leather based material (among others). Each surface may be covered with the same material. Alternatively, different materials may be used to cover the surfaces. For example, an initial surface of the inflatable component 15 may be covered with a felt based material to cushion a contact based action during an exercise. An adjacent surface may be covered with a cloth based or a leather based material to provide a harder surface for another type of contact based action. Furthermore, surface(s) of the inflatable component 15 may be overlaid with a removable cover (such as a felt, cloth, or leather based cover attachable to the service with Velcro or other attachment mechanism). The portable cover may allow the user to furnish a surface with a material that is suitable to the exercise type. Alternatively, an entirety of the inflatable component 15 may be enclosed within a removable cover in a bag like form factor.

The inflatable component 15 may also have a loop attached at opposing ends to secure the inflatable component 15 to a structure (such as a door frame or an archway of a wall). For example, a top loop 16 may be integrated to a top end of the inflatable component 15. The top loop 16 may be used to attach the inflatable component 15 to a clamp 18. The top loop 16 may be attached to the clamp 18 with a cord to secure the inflatable component 15 to the clamp 18. The cord may have a fixed length to stabilize a position of the inflatable component 15 in relation to the structure. The clamp 18 may be used to secure the inflatable component 15 to the structure.

An ankle cuff 17 may be attached to a bottom loop 26. The bottom loop 26 may be integrated to a bottom end of the inflatable component 15. The ankle cuff 17 may be used to secure the inflatable component 15 to the user. The ankle cuff 17 may be attached to the bottom loop 26 with another cord. The other cord may have an adjustable length to allow the user set an optimal length to achieve comfortable use with the ankle cuff 17 in relation to the inflatable component 17. The user may wear the ankle cuff 17 on an ankle, as such, secure the inflatable component 15 during an exercise. For example, the user may prevent an excess motion of the inflatable component 15 by pulling on the ankle cuff 17 and tightening the inflatable component 15 relative to the clamp 18 during the exercise. Alternatively, the user may adjust a flexibility and/or a mobility of the inflatable component 15 by relaxing or pulling on the ankle cuff 17 during the exercise. Other mechanisms may be used to secure the inflatable component 15 to the user. For example, a wrist cuff may be used to secure the inflatable component 15 to an arm of the user with a cord connecting the wrist cuff and the bottom loop 26.

Figure 6:
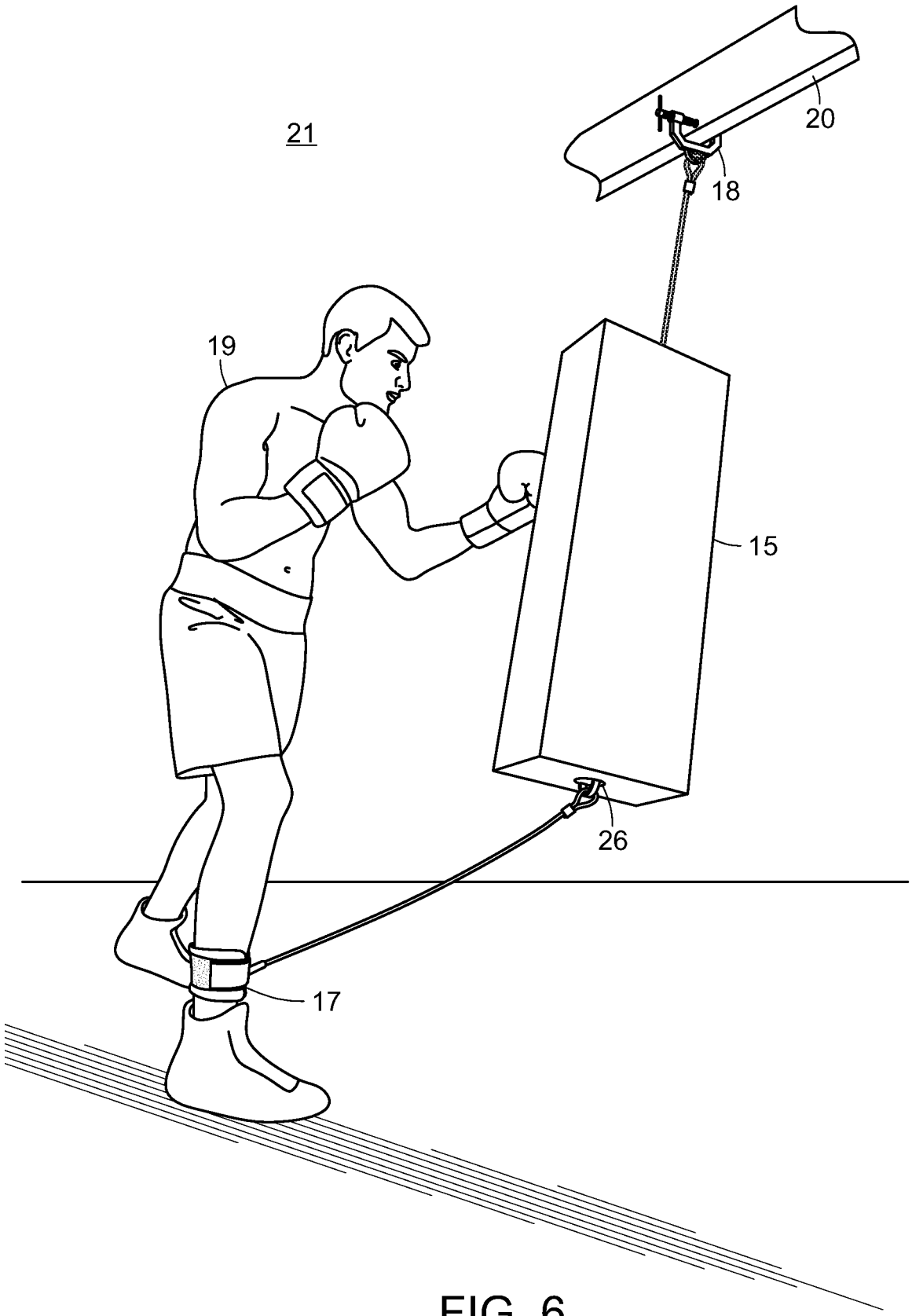
FIG. 6 shows an embodiment of the invention with the inflatable exercise apparatus.

FIG. 6 shows the inflatable exercise apparatus 21 operated by a user 19. The inflatable component 15 may be secured to a door frame 20 with the clamp 18. The clamp 18 may be secured to the door frame 20. The inflatable component 15 may be attached to the clamp through a cord connected to the top loop 16. The top loop 16 may be integrated to the top end of the inflatable component 15. The user 19 may also secure the inflatable component 15 to a body component such as a leg by wearing the ankle cuff 17. The ankle cuff 17 may be attached to the inflatable component 15 with another cord. The cord may be connected to the bottom loop which may be integrated to the bottom section of the inflatable component 15. The user 19 may control a mobility of the inflatable component 15 by pulling on or relaxing the cuff 17 to constrict or relax the inflatable component 15 relative to the clamp 18.

A method of configuring an inflatable exercise apparatus is also described. The method may include securing a clamp to a structure. The structure may include a top section of a door frame. Next, an inflatable component may be connected to the clamp. A top loop may be integrated to a top end of the inflatable component. The top loop may be attached to the clamp with a cord. Furthermore, an ankle cuff may be attached to a bottom loop. The bottom loop may be integrated to the inflatable component. The ankle cuff may be attached to the bottom loop with another cord. The other cord may include an adjustable length. The ankle cuff may also be secured to a body component. The body component may include a leg.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An inflatable exercise apparatus, comprising:

an inflatable component with a top end and a bottom end, wherein the inflatable component comprises a rectangular shape when inflated;

a top loop coupled to the top end and a bottom loop coupled to the bottom end;

a clamp configured to secure to a structure, wherein the clamp is configured to couple to the top loop; and an ankle cuff configured to couple to the bottom loop, wherein the ankle cuff is configured to couple to the bottom loop with a cord, and wherein the cord includes an adjustable length.

2. The inflatable exercise apparatus of claim 1, wherein the clamp is configured to couple to the top loop with a cord.

3. The inflatable exercise apparatus of claim 1, wherein the structure comprises a top section of a door frame or an archway.

4. The inflatable exercise apparatus of claim 1, wherein the ankle cuff is wearable by a user.

5. The inflatable exercise apparatus of claim 1, wherein one or more surfaces of the inflatable component is covered with a felt based material.

6. The inflatable exercise apparatus of claim 1, wherein one or more surfaces of the inflatable component is covered with a cloth or a leather based material.

7. An exercise system comprising:

an inflatable component with a top end and a bottom end, wherein the inflatable component comprises a rectangular shape when inflated;

a top loop integrated to the top end and a bottom loop integrated to the bottom end;

a clamp secured to a structure, wherein the clamp is attached to the top loop with a fixed length cord; and an ankle cuff configured to couple to the bottom loop with an adjustable length cord.

8. The system of claim 7, wherein the inflatable component is partitioned to one or more compartments.

9. The system of claim 8, wherein the one or more compartments are fillable with a gas or a fluid to adjust a weight or a density of the inflatable component.

10. The system of claim 7, wherein the inflatable component comprises dimensions including a length of 122 cm, a width of 25.4 cm, and a depth of 61 cm, approximately.

11. A method of configuring an inflatable exercise apparatus, the method comprising:

securing a clamp to a structure, wherein the structure includes a top section of a door frame;

connecting an inflatable component to the clamp, wherein a top loop integrated to a top end of the inflatable component is attached to the clamp with a first cord;

attaching an ankle cuff to a bottom loop integrated to the inflatable component with a second cord, wherein the second cord includes an adjustable length; and securing the ankle cuff to a body component, wherein the body component includes a leg.

* * * * *